US005131654A

United States Patent [19]

Gottlieb et al.

[11] Patent Number: 5,131,654

[45] Date of Patent: Jul. 21, 1992

[54] AUTOMATIC FLIPPER ACTUATOR SYSTEM FOR USE IN A PINBALL GAME

[75] Inventors: Alvin J. Gottlieb, Elmhurst; Jerry W. Armstrong, Downers Grove, both of Ill.

[73] Assignee: A. Gottlieb & Co., Melrose Park, Ill.

[21] Appl. No.: 739,877

[22] Filed: Aug. 2, 1991

Related U.S. Application Data

[63] Continuation-in-part of Ser. No. 566,630, Aug. 13, 1990, Pat. No. 5,064,196, which is a continuation-in-part of Ser. No. 392,050, Aug. 10, 1989, Pat. No. 4,971,323.

[51] Int. Cl.[5] ..... A63F 7/30

[52] U.S. Cl. ..... 273/121 A; 273/129 V

[58] Field of Search ..... 273/118 R, 118 A, 118 D, 273/119 R, 119 A, 120 R, 120 A, 121 R, 121 A, 122 R, 122 A, 127 R, 129 R, 129 S, 129 V, 129 W

[56] References Cited

U.S. PATENT DOCUMENTS

| | | | |
|---|---|---|---|
| 2,319,786 | 5/1943 | Binks | 273/118 A |
| 2,328,667 | 9/1943 | Nicolaus | 273/118 A |
| 2,520,283 | 8/1950 | Koci | 273/129 R |
| 2,727,743 | 12/1955 | Von Stoeser | 273/118 A |
| 3,298,691 | 1/1967 | Berninger et al. | 273/129 R |
| 3,675,927 | 7/1972 | Gottlieb et al. | 273/119 R |
| 4,203,603 | 5/1980 | Konta | 273/129 W |
| 4,431,188 | 2/1984 | Hooker | 273/121 A |
| 4,438,928 | 3/1984 | Wiczer | 273/121 R |
| 4,971,323 | 11/1990 | Gottlieb | 273/129 V |
| 4,986,543 | 1/1991 | Heller | 273/121 A |
| 4,991,845 | 2/1991 | Wies | 273/121 A |
| 5,064,196 | 11/1991 | Gottlieb | 273/121 A |

FOREIGN PATENT DOCUMENTS

88/10138 12/1988 PCT Int'l Appl. .

OTHER PUBLICATIONS

Brochure for "Joust" pinball game sold by Williams.

Brochure for pinball game sold by Komputer Dynamics.

*Primary Examiner*—William H. Grieb

*Assistant Examiner*—Raleigh W. Chiu

*Attorney, Agent, or Firm*—Willian Brinks Olds Hofer Gilson & Lione

[57] ABSTRACT

A multi-surface pinball machine, which may be played by one or more players. The surfaces connect at an apex, and one or more players stand at the outer ends of each surface. An automatic flipper actuator is provided for play of the game with the number of players less than the number of surfaces. The machine can operatively be switched from the multi-player mode to as little as a single player mode. In such a mode, software controls the flippers of the missing players. Thus, the multi-surface table allows for either simultaneous competitive play by two or more players, or play by as little as one player competing against the machine.

19 Claims, 4 Drawing Sheets

AUTOMATIC FLIPPER ACTUATOR SYSTEM FOR USE IN A PINBALL GAME

This application is a continuation-in-part of application Ser. No. 07/566,630, filed Aug. 13, 1990, which is a continuation-in-part of Ser. No. 07/392,050, filed Aug. 10, 1989.

A portion of the disclosure of this patent document contains material which is subject to copyright protection. The copyright owner has no objection to the facsimile reproduction by any one of the patent disclosure, as it appears in the Patent and Trademark Office patent files or records, but otherwise reserves all copyright rights whatsoever.

BACKGROUND OF THE INVENTION

The present invention relates generally to a rolling ball game such as a pinball game, and more particularly to a pinball game having an automatic flipper actuator system that allows the pinball machine to move flippers on the game without a player actuating these flippers.

For years, pinball machines or games have provided a source of leisure time enjoyment for a variety of people. Despite the recent proliferation of computerized video arcades, pinball continues to be recognized as a popular pastime. Pinball games offer the player the ability to manipulate an actual physical object (the ball) as opposed to a character on a screen.

When playing pinball, a player usually sets the ball into play with a spring biased arm or plunger. As the ball strikes various scoring elements, such as post bumpers and slingshot bumpers, the player earns points according to the number of times the ball strikes the bumper and the point value of each bumper. The player has no control over the movement or placement of these scoring elements, and once he or she sets the ball into motion, the ball randomly strikes various bumpers and other scoring elements.

Because the ball rolling or playing surface of the pinball table is gently sloped, the force of gravity constantly urges the ball towards the base of the table. Usually mounted near the base of the table are two flippers that may be electro-mechanically actuated by the player by depressing the buttons located on the side of the machine's cabinet. By correctly timing the actuating of the flippers, the player can cause the flippers to strike the ball and propel it into the playing area to again contact the various scoring elements in order to score further points.

In contrast with the bumpers or other scoring elements, movement of the flippers is within the control of the player. These flippers do not detect ball contact like the bumpers, however, and no points are scored as a result of contact between the flipper and the ball. The flippers are merely ball propelling devices. The primary purpose of the flipper is to keep the ball in play and prevent it from escaping the playing field by passing through the space located between the flippers thereby ending the play of that particular ball. This limited control over the scoring elements of the game leaves the present pinball game with some deficiencies.

As developed over the years, pinball is primarily an individual activity. Games where two players play simultaneously, however, are known, as illustrated in Gottlieb et al., U.S. Pat. No. 3,675,927. However, in the pinball game disclosed in this patent, one player must assume a defensive role while the other maintains an offensive role. Games where two players compete simultaneously—both players assuming both offensive and defensive roles during the same play of the game—are also known, as illustrated in Gottlieb, U.S. Pat. No. 4,971,323. However, in the pinball game disclosed in this patent, no provision is made whereby a single player can play the game alone against the game itself.

What is lacking is a feature that would allow both the simultaneous play by two players as described in Gottlieb '323, with the option of allowing one player to play the game alone against the machine, a computer or the like. Often times, a second player will not be available, or two players of equal skill may not be present to fully enjoy the game. Further, the game described in Gottlieb '323 does not allow a single player to practice to improve his or her skill, or to compete against a consistent and experienced adversary such as the machine itself.

An ideal pinball machine, therefore, would allow for true, simultaneous two-player competition, while at the same time providing an option for one player to play the game alone. In this situation, the machine must provide a feature which allows the players to selectively switch between the two-player and one-player modes.

In the one-player mode, the pinball machine itself will have to control the flippers otherwise operated by the missing player. In this "automatic" mode, a single player can play the game as if a second player were competing against him or her. Play of the game in the single-player, automatic mode allows the player to compete against the machine itself, or to practice in order to improve his or her ability to compete when a second player is present.

SUMMARY OF THE INVENTION

In view of the above, it is an objective of this invention to provide a pinball game or machine where two or more players can play simultaneously and in competition with each other, and where a single player can compete alone against the "machine" in order to beat the machine or to better his or her score. In the invention, a pinball game, including a playing surface and a ball, is provided. Disposed on the playing surface is a flipper element that is movably mounted relative to the playing surface. The flipper element includes a contact surface employing a sensor, which is used to detect impact with the contact surface. An automatic flipper actuating mechanism is coupled to the flipper element and automatically actuates the flipper element upon impact of the ball with the contact surface. After the initial impact, the sensor remains in continuous contact with the ball as the flipper element moves across the playing surface.

In a preferred embodiment, a dual-surface pinball table is employed where each surface meets at the center of the pinball table. In this configuration, the ball is free to travel from one surface to another, and score points on any surface of the pinball table. A mechanism is also provided that allows the user to switch between two-player and single-player modes. In this 1 embodiment, the player who last contacted the ball with a ball-engaging mechanism under that player's control is credited with any subsequently scored points.

Further embodiments include the addition of offensive flipper elements controlled by a first player, but located on the second player's surface. Such flipper elements would also include the contact surface and sensor of the main flippers, and are also subject to control by the automatic flipper actuating mechanism in the appropriate playing mode. A further embodiment includes the ability to score points for a ball that impacts an opponent's flipper element if the opponent does not engage or actuate his flipper element.

The present invention has numerous advantages over pinball games or machines heretofore known in the art. With the present invention, players may compete simultaneously against each other, or individually against the machine itself. The ability to switch between the single player and two-player modes combines the advantages of the prior art with those of the invention in a single game. Further, the present invention is not limited to two players. In one embodiment of the present invention, more than two playing surfaces can be joined for an unlimited number of players.

The present invention will be further understood in view of the following detailed description of some presently preferred embodiments of the invention taken in conjunction with the accompanying drawings.

DETAILED DESCRIPTION OF THE PRESENTLY PREFERRED EMBODIMENTS OF THE INVENTION

Figure 1:
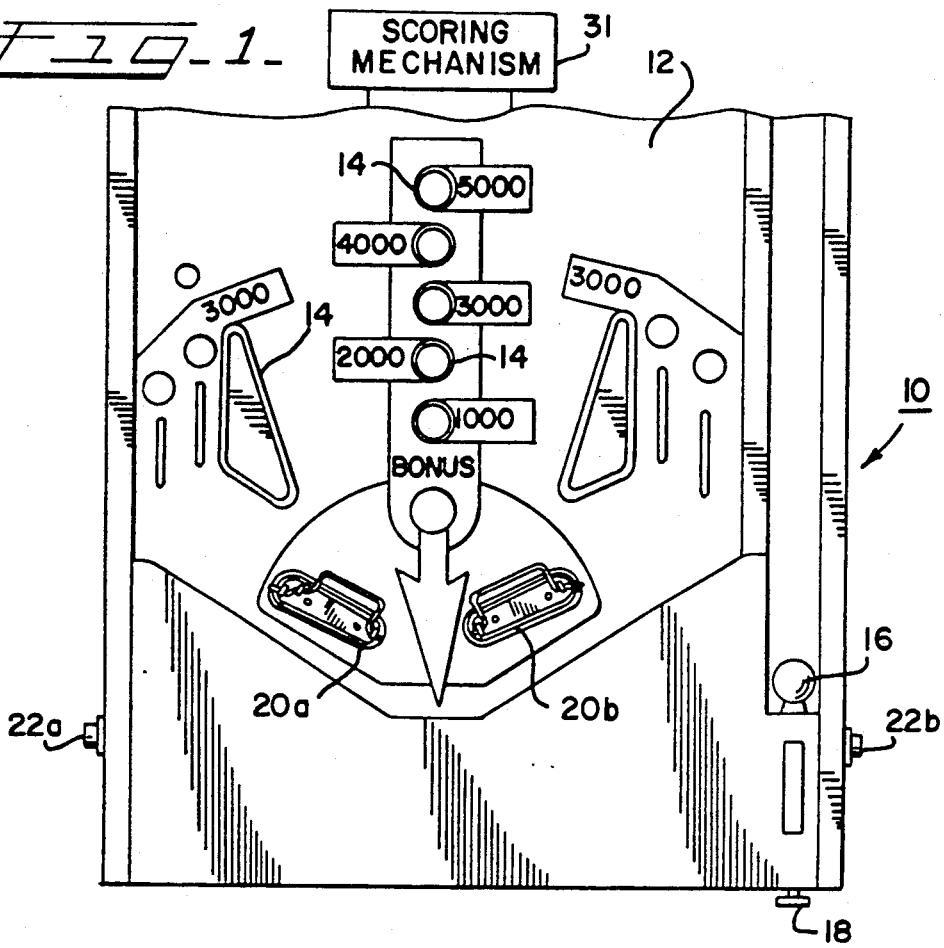
FIG. 1 is a top plan view of that part of a sensor-equipped flippers made in accordance with the present invention.

Reference is now made to the figures wherein FIG. 1 shows a rolling ball game such as a pinball game or pinball machine. More particularly, in FIG. 1, a rolling ball game with a ball rolling surface or playing surface 12 is generally designated as 10. Although the following description of the invention is directed to a pinball machine, it will be recognized that the invention may be used on other games including games that do not use a "pinball", per se, but use any projectile object that moves across a playing surface under its own, or programmed, inertia, such as a puck, cylinder or other figure including a video game "cursor" or the like.

A plurality of ball-engaging mechanisms 14 are mounted on the playing surface 12 shown in FIG. 1. The ball-engaging mechanisms 14 may include a variety of elements such as post bumpers and slingshot bumpers, as well as other similar ball-engaging mechanisms that are well known in the art.

The ball-engaging mechanisms have a point value assigned to them such that when they are struck with a ball 16 during the play of the game the player is credited with the assigned point value. Additionally, ball-engaging mechanisms for the game may include an element that propels the ball away from the ball-engaging mechanism when contacted by the ball, such as leaf or trigger switches (not shown). Such ball-engaging mechanisms are known in the art.

The pinball machine 10 further includes a plunger 18 which is biased with a spring (not shown), used to propel a ball 16 onto the playing surface 12 for play. The player stands at the end of the machine where the plunger 18 is located. The playing surface 12 is sloped at a slight angle with respect to the horizontal so that the ball rolls toward the player. The ball contacts the ball-engaging mechanisms 14, and eventually works its way toward the player.

One or more ball-engaging mechanisms are operable by the player by means of a control element. As illustrated in FIG. 1, flippers 20*a* and 20*b* with their corresponding control buttons 22*a* and 22*b* are such moveable, player-controlled, ball-engaging mechanisms. Both flippers 20*a* and 20*b* can be actuated by pressing only one flipper button 22*a* or 22*b*, or alternatively, each flipper may be controlled by a separate, independent control mechanism. In a preferred embodiment, the left flipper button 22*a* corresponds to the left flipper 20*a* and the right flipper button 22*b* corresponds to the right flipper 22*b*, thereby allowing for independent actuation of the flippers 20*a* and 20*b*.

Figure 2:
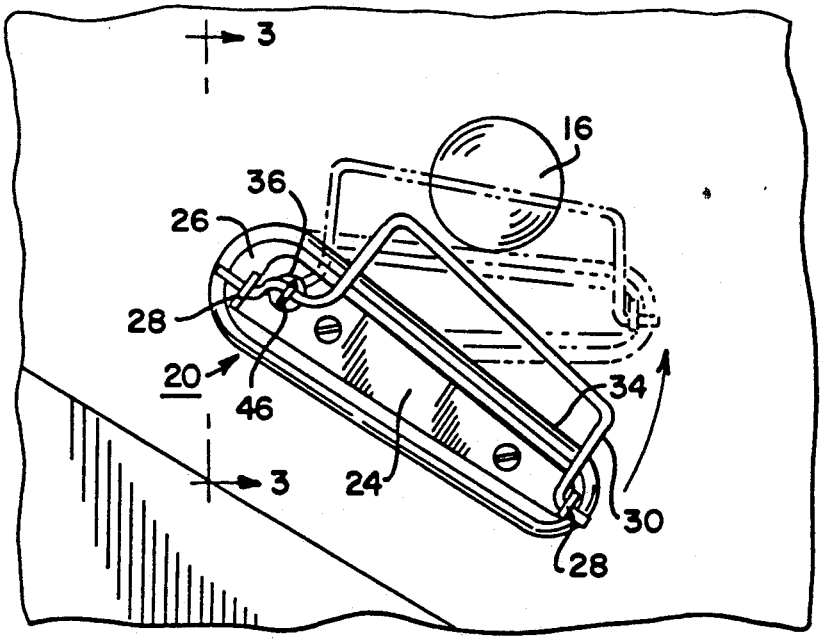
FIG. 2 is an enlarged top-plan view of a flipper utilized on the pinball table of FIG. 1.
Figure 3:
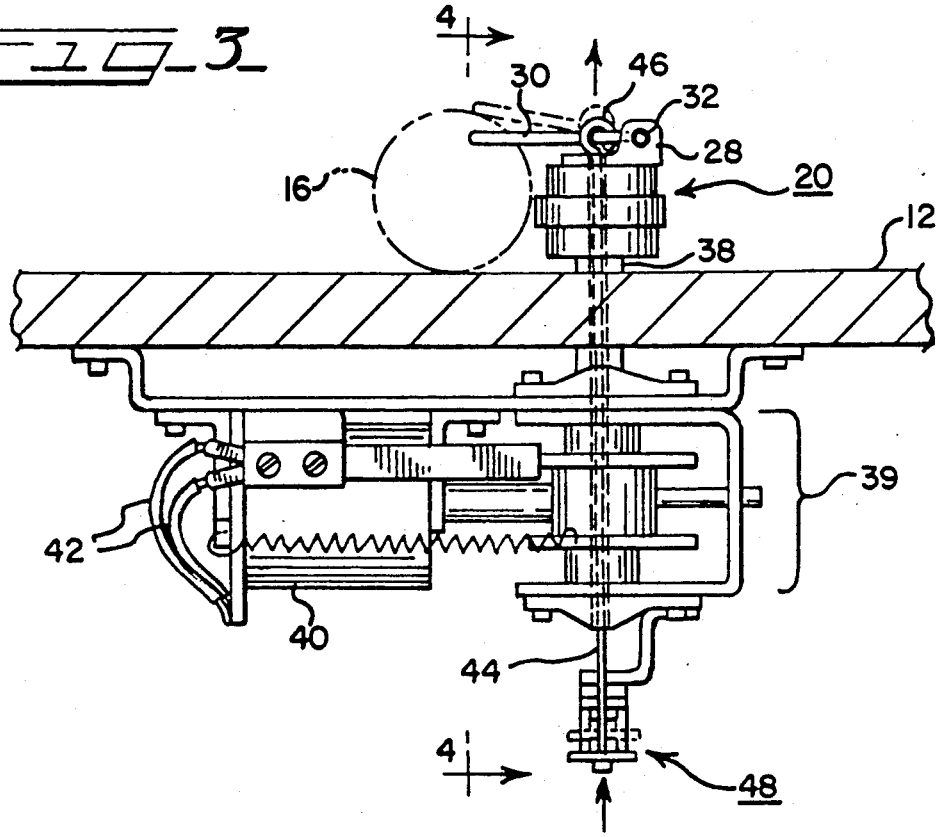
FIG. 3 is a sectional view taken along line 3—3 of FIG. 2.
Figure 4:
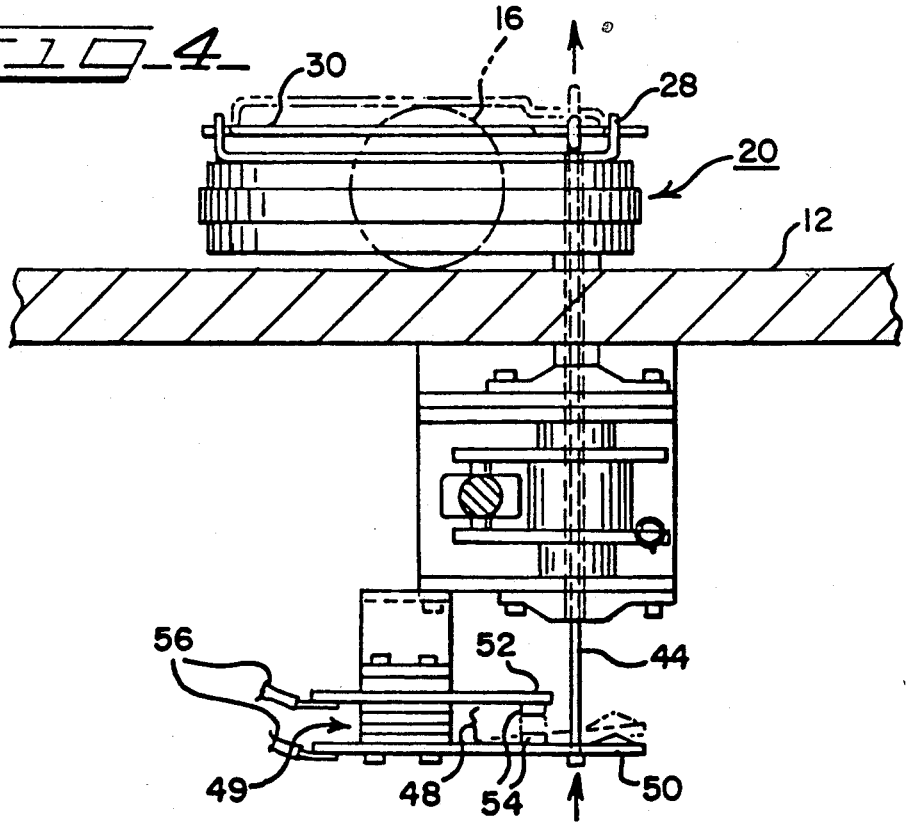
FIG. 4 is a sectional view taken along line 4—4 of FIG. 3.

Means are provided for detecting contact of the moveable, ball-engaging mechanisms 20—the flippers—with the ball 16. As seen in FIGS. 2-4, a U-shaped wire gate 30 is attached to each flipper 20*a* and 20*b*. Each flipper comprises an elongated bar 24 which is pivotally mounted at one end such that the flipper can move 1 relative to, or across, the playing surface 12. When the ball 16 contacts either flipper 20*a* or 20*b*, the wire gate 30 pivots and is raised. The wire gate 30, in turn, actuates a scoring mechanism 31 that detects and records the contact of the ball 16 with the flipper. Such scoring and engaging mechanisms are not limited to use in pinball games alone, but may be configured with means for detecting contact of video game elements, such as a cursor, puck or any other moving, scoring elements known in the art. A more detailed description and some preferred embodiments of the means for detecting contact with the ball are disclosed in Gottlieb, U.S. Pat. No. 4,971,323, the contents of which are hereby incorporated by reference.

Besides scoring points from engaging the flipper itself, the scoring mechanism 31 preferably also thereafter credits points scored as the ball 16 hits various other scoring elements 14 to the player that last contacted the ball 16. In one of the embodiments of the invention illustrated in FIG. 1, in a two player mode, a first player can maintain control over the left flipper while a second player maintains control over the right flipper. When the first player's flipper comes into contact with the ball 16, the wire gate 30 is raised, thereby triggering the scoring mechanism 31. However, in a more preferred embodiment of the present invention shown in FIG. 5 one player maintains control over both flippers 66 on his or her side 58 of the playing table 56, while the opposing player maintains control of both flippers 68 on the other side 60 of the playing table.

With the scoring mechanism 31 (FIG. 1) triggered in favor of the first player, all subsequent points scored as the ball strikes various scoring elements 14 on either playing surface are credited to the first player. The first player will continue to score points until the second player makes contact with the ball 16 by activating his flipper gate 20*a* or 20*b*, thereby triggering the scoring mechanism 31 in favor of the second player. In the event the ball 16 contacts one of the second player's flippers 20*a* or 20*b* without the second player activating one of his or her flipper buttons 22*a* or 22*b*, the first player will also score points as if the flippers 20*a* or 20*b* were normal scoring elements 14 disposed about the playing surface 12.

Figure 6:
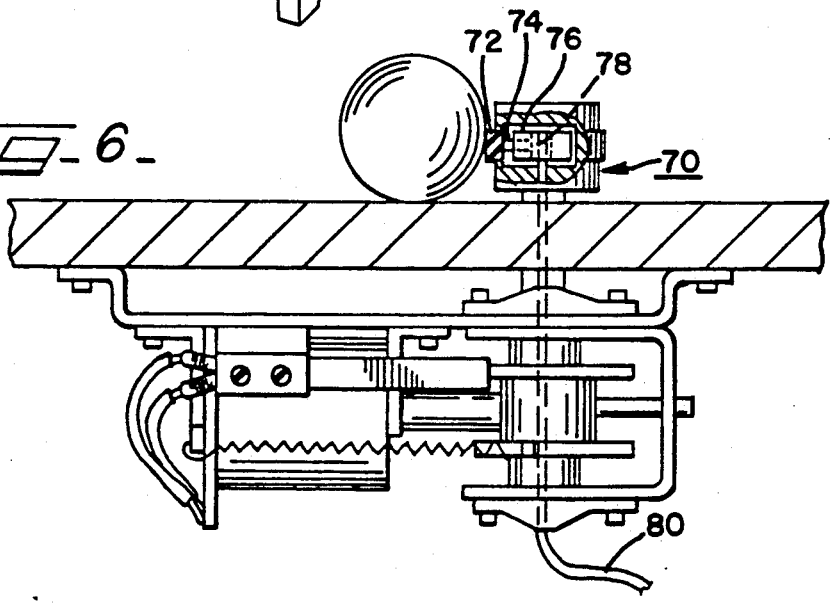
FIG. 6 is a sectional view similar to that of FIG. 3 of an alternative embodiment of a flipper made in accordance with the present invention.

Another embodiment of a means for detecting contact with the ball 16 is shown in FIG. 6. A flipper is illustrated with a bumper 72, such as is typically included on most conventional flippers. The bumper 72, however, is modified with a sliding or plunger-type contact 74 within and running the length of the bumper 72. The contact 74 is attached to the inside of the bumper 72, which is usually made of an elastic material, thereby biasing the sliding contact 74 outboard relative to the bumper 72. A more detailed description of the operation of the embodiment shown in FIG. 6 appears in the above referenced Gottlieb '323 patent.

It will be appreciated that, in addition to those disclosed above, a variety of similar means may be provided for detecting contact with the ball on player controlled ball-engaging mechanisms. For example, ball contact could be detected by breaking of a constant beam of light or by magnetic sensitive contacts.

It will further be appreciated that not only flippers, but other ball-engaging mechanisms may also include such means for player control and ball detection. For example, in some variations of the game, it may be desirable to include such means for player control of movement of a scoring element 14 such as a bumper, which contains ball detecting means. Additionally, it may be desirable to include a specially designated bumper with means for detecting contact with the ball 16 so that the ability to score points is not solely a function of whose flipper was last to contact the ball 16.

Figure 5:
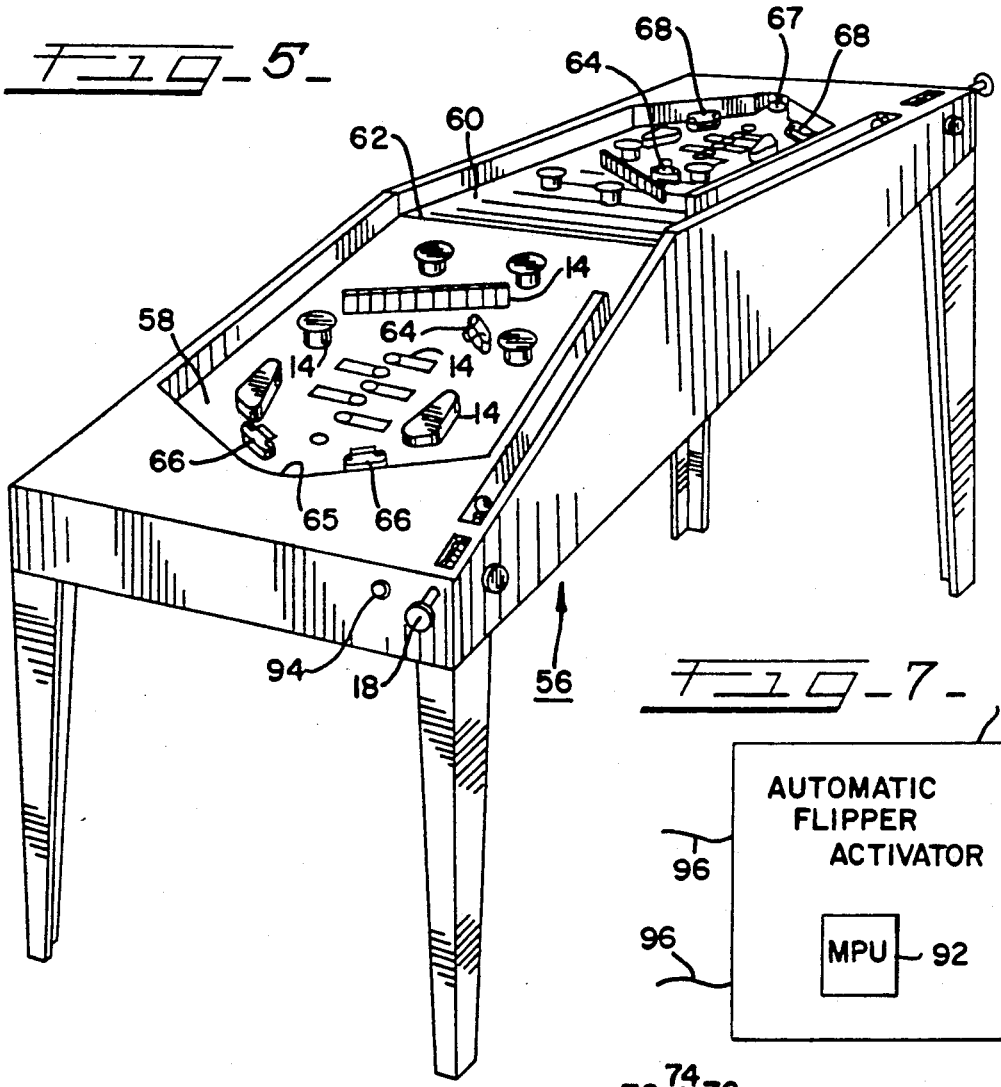
FIG. 5 is a perspective view of a dual-surface pinball table made in accordance with the present invention.

FIG. 5 illustrates a preferred embodiment of the multi-surface table of the present invention having two playing surfaces. In FIG. 5, a dual-surface pinball table is generally designated as 56. The dual-surface pinball table 56 includes a first playing surface 58 and a second playing surface 60. When playing competitive pinball with a dual-surface pinball table, a first player stands at the outer end of the first playing surface 58, with a second player standing at the outer end of the second playing surface 60.

Both playing surfaces 58 and 60 are inclined at opposing angles with respect to the horizontal. Thus, both surfaces 58, 60 meet to form a ridge or apex 62. The ball 16 can roll over the apex 62 onto either playing surface 58, 60. Each playing surface 58, 60 also has a variety of scoring elements 14 attached thereto.

Additionally, at least a pair of flippers 66 and 68 is provided for each playing surface 58, 60. In a preferred embodiment, each set of flippers is configured so that the flippers operate independently. Thus, in one embodiment, two players can operate both flippers on that playing surface 58, 60 simultaneously and in competition with the other player. However, when utilizing a dualsurface pinball table 56, it is preferable that the flippers 66, 68 be configured such that both flippers in a pair correspond to the player standing at that end of the respective playing surface 58, 60.

In an alternate embodiment to the flipper configuration on the dual-surface pinball table 56, additional "offensive" flippers 64 can be positioned on the opposing player's playing surface 58, 60. Providing such an offensive flipper 64 introduces a further element of strategy and skill to the dual-player pinball game 56. Due to the inclined nature of the surfaces 58, 60, the offensive flipper 64 is more accurate in targeting the ball 16 to the other player's goal or out-hole 65, 67. Shooting a ball from the oppositely configured flippers 66, 68 requires that the ball traverse the ridge or apex 62 before it can progress towards the respective out-hole 65, 67. By using the offensive flipper 64, a first player can not only deprive a second player of additional points to be scored on the second player's playing surface 60 by "stealing" the ball 16, but can more easily score a "goal" by having a direct shot at the second player's out-hole 67.

In a preferred embodiment of the dual-player pinball game 56, a switch 94 is provided which allows the user to alternate between the two-player mode described above, and the "automatic" one-player mode. In the oneplayer mode, an automatic flipper actuator mechanism 90 (FIG. 7) is provided that operates the flippers 66 or 68 of the missing second player. Such a switch 94 is provided on the exterior of the pinball machine 56 (FIG. 5) and may constitute a push-button switch or other switches known in the art.

Figure 7:
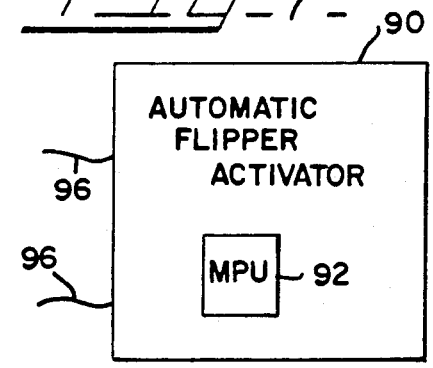
FIG. 7 is a block diagram of an automatic flipper actuator mechanism made in accordance with the present invention.

In this preferred embodiment, the automatic flipper actuator mechanism 90 comprises a microprocessor 92 and suitable software. Preferably, the microprocessor is the 65c02 microprocessor manufactured by Rockwell International Corporation. As shown in FIG. 7, the automatic flipper actuator 90 is connected to the pinball game 56 through lead lines 96. A flowchart of the software used to implement the automatic flipper actuator mechanism in this preferred embodiment is provided in FIG. 8.

When the game is in the one player mode, the software used to control automatically the second set of flippers 66 or 68 must initially determine whether the ball 16 has impacted one of the flippers 66 or 68, and if so, to actuate that flipper. In one presently preferred embodiment, all of the flippers 66 and 68 controlled by the automatic flipper actuator 90 are operated simultaneously upon impact of the ball 16. As a result, if the ball 16 impacts any one of these flippers 66 or 68, all of the flippers 66 or 68 are actuated. In an alternate embodiment, the flippers 66 or 68 can be independently controlled by the flipper actuator mechanism 90 such that impact of the ball 16 with a flipper 66 or 68 only results in actuation of that flipper.

The automatic flipper actuator mechanism 90 ideally consists of a subroutine of a larger program used to keep track of scores and generally operate the pinball game 56. Upon entering the automatic flipper actuator subroutine (FIG. 8), the machine must first determine whether the game is set to the automatic, single-player mode. If the automatic mode is not set, the program skips from step 100 to step 102 and bypasses the subroutine altogether and the flippers at both ends of the pinball game 56 may then be operated by individual players through the control buttons. In one embodiment where the game 56 is operating in a demonstration mode, all of the flippers 64, 66 and 68 may be controlled by the automatic flipper actuator 90, and no players are playing the game.

Figure 8:
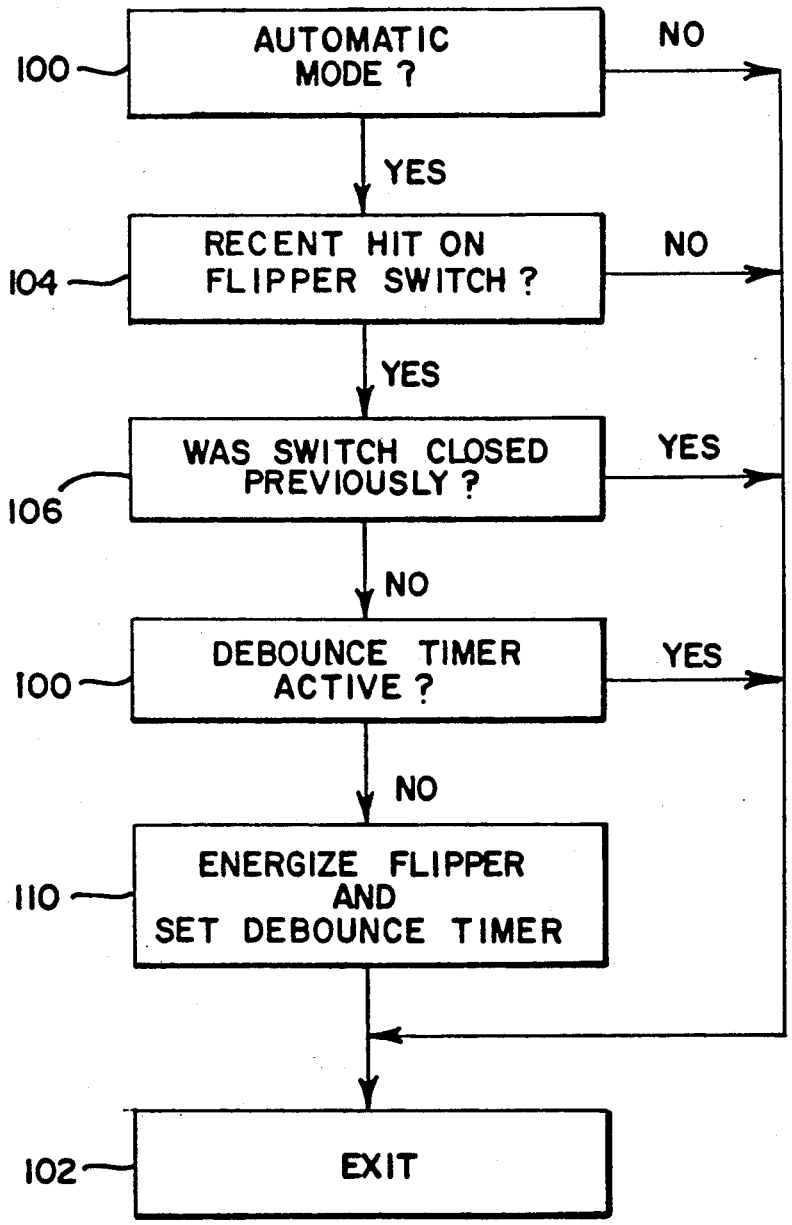
FIG. 8 is a flow chart of the presently preferred software used in the automatic flipper actuator system made according to the present invention.

As shown in FIG. 8, if the automatic mode has been selected by operation of the witch 94, the program advances to step 104. In step 104, the subroutine must next determine whether one of the automatic flippers has been impacted by the ball 16. If so, the program continues on to step 106 to determine whether the switch on the flipper is open or closed. If the switch has closed, the actuator function is complete and the program drops down to step 102 to exit the subroutine.

If the switch was not previously closed, the program progresses to step 108 to determine if the automatically controlled flipper 64, 66 or 68 has already been energized. In order to prevent a double hit by the flipper, the switch on the flipper 64, 66 or 68 must be "debounced". In a preferred embodiment, the debounce function is implemented by way of a software timer. After initial actuation of the flipper, the actuator can no longer be engaged for a pre-selected time interval. In this preferred embodiment, the pre-selected time interval is greater than or equal to 24 milliseconds.

If the flipper has been actuated, the subroutine is complete and the program progresses to step 102. If not, the program energizes or actuates the flipper in step 110. At the same time that the flipper is actuated, the software debounce timer is engaged to prevent reactuating the flipper.

Once the flipper has been actuated, the subroutine is complete and control returns to the main program through step 102. Any subsequent impact of an automatically controlled flipper re-activates the subroutine at its entry point in step 100. A preferred embodiment of the assembly language source code that implements the above subroutine is attached hereto as an Appendix.

A dual-surface table could also be adapted to provide a competitive pinball game in which four players can play simultaneously. By adjusting the scoring mechanism 31 to record four separate scores and assigning one player to each flipper, similar to the embodiment in FIG. 1, four players would be able to independently score points and thereby compete with each other. Alternatively, other embodiments may include additional playing surfaces so that more players can be added and each maintain control over both flippers positioned on their playing surface.

It can be seen that the automatic flipper actuator mechanism of the invention provides many advantages over the prior art. A single-player mode allows the player to improve his or her skill, or to compete against a skilled adversary such as the machine itself. Switching between the single-player and two-player modes combines the advantages of the invention with an already exciting and new form of truly competitive pinball.

Other advantages of the invention include the use of offensive flippers which add a further element of strategy and excitement to the game. Also, the ability to score points for impacting an opponent's flippers before the opponent can respond by engaging that flipper adds a further element of skill to the dual-surface pinball game.

The invention may be embodied in other forms than those specifically disclosed herein without departing from its spirit or essential characteristics. The described embodiments are to be considered in all respects only as illustrative and not restrictive, and the scope of the invention is commensurate with the appended claims rather than the foregoing description.

We claim:

1. A pinball game, including a playing surface and a ball, to be played by at least one player, comprising:

a flipper element including a contact surface, the flipper element movably mounted relative to the playing surface;

a sensor operatively connected to the flipper element to detect impact with the contact surface; and an automatic flipper actuating mechanism, coupled to the flipper element, for automatically actuating the flipper element upon impact of the ball with the contact surface;

wherein the flipper element remains in contact with the ball as the flipper element moves across the playing surface.

2. The pinball game defined in claim 1, further comprising a scoring mechanism operatively connected to the sensor such that points are allocated to the player upon impact of the ball with the contact surface.

3. The pinball game defined in claim 1, further comprising a scoring mechanism operatively connected to the sensor such that points are not allocated to the player if the flipper element is actuated upon impact of the ball with the contact surface.

4. The pinball game defined in claim 1, further comprising a plurality of flipper elements, wherein a first player operates a first set of the flipper elements and the automatic flipper actuating mechanism operates a second set of the flipper elements.

5. The pinball game defined in claim 1, further comprising a plurality of flipper elements, wherein a first player operates a first set of the flipper elements and a second player operates a second set of the flipper elements.

6. The pinball game defined in claim 1, further comprising a control mechanism for use by a player to actuate the flipper, means for selectively switching the actuation of the flipper between the automatic flipper actuating mechanism and the control mechanism thereby switching between a single-player and a multi-player mode. 1

7. The pinball game defined in claim 1, wherein the automatic flipper actuating mechanism comprises a microprocessor and software.

8. A pinball game, including a ball, to be played by at least one player, comprising:

at least one playing surface, upon which the ball travels;

a plurality of targets disposed on the at least one playing surface and to which a point value is assigned;

a first set of flipper elements operable by a first player and including a contact surface, the flipper elements movably mounted relative to the at least one playing surface;

a second set of flipper elements, including a contact surface, selectively operable between an automatic flipper actuating mechanism and a second player, the flipper elements movably mounted relative to the at least one playing surface;

a sensor operatively connected to the flipper elements to detect impact with the contact surface; and a scoring mechanism operatively connected to the sensor for recording the points accumulated by a first player after the ball contacts a flipper element associated with the first player until the ball contacts a flipper element associated with the automatic flipper actuating mechanism, and the points accumulated by the automatic flipper control mechanism after the ball contacts a flipper element associated with the automatic flipper actuating mechanism until the ball contacts a flipper element associated with the first player;

wherein the sensor remains in continuous contact with the ball as the flipper element moves across the at least one playing surface.

9. The pinball game defined in claim 8, wherein the scoring mechanism allocate points to the player upon impact of the ball with the contact surface.

10. The pinball game defined in claim 8, wherein the scoring mechanism does not allocate points to the player if the flipper element is actuated upon impact of the ball with the contact surface.

11. The pinball game defined in claim 8, wherein at least one of the flippers in both the first and second sets of flipper elements comprises an offensive flipper disposed on a first playing surface associated with the first player, and a second playing surface associated with the automatic flipper actuating mechanism or the second player.

12. The pinball game defined in claim 8, further comprising means for selectively switching between a single-player and a multi-player mode.

13. The pinball game defined in claim 8, wherein the automatic flipper actuating mechanism comprises a microprocessor and software.

14. The pinball game defined in claim 8, wherein the scoring mechanism switches between the first player and the automatic flipper control mechanism if the first player operates a flipper element associated with the first player to engage the ball.

15. The pinball game defined in claim 8, wherein the automatic flipper actuating mechanism always engages a flipper element associated with the automatic flipper actuating mechanism upon contact of that flipper element with the ball.

16. A method for automatically controlling a flipper element in a pinball game, including a ball, comprising the steps of:

detecting impact between the ball and a first flipper element;

automatically engaging the first flipper element to propel the ball away from the first flipper element, the flipper element all the while maintaining contact with the ball from the time of impact to the time 1 of release; and biasing a scoring mechanism to accumulate all subsequently scored points to a score element associated with the first flipper element until a second flipper element not associated with the automatically controlled flipper element engages the ball.

17. The method defined in claim 16, wherein a player operates the second flipper element.

18. The method defined in claim 16, wherein the scoring mechanism attributes points to the score element associated with the first flipper element for impact with the second flipper element if the ball impacts the second flipper element without the second flipper element being actuated.

19. The method defined in claim 16, further comprising the step of selectively switching between a single-player and a multi-player game mode.

* * * * *

UNITED STATES PATENT AND TRADEMARK OFFICE

CERTIFICATE OF CORRECTION

PATENT NO. : 5,131,654

DATED : July 21, 1992

INVENTOR(S) : Alvin J. Gottlieb et al.

It is certified that error appears in the above-indentified patent and that said Letters Patent is hereby corrected as shown below:

In column 3, line 22, after the second occurrence of "a" insert --pinball table which employs a preferred embodiment of the--.

In column 4, line 25, delete "22*b*" and substitute therefor --206--.

In column 4, line 33, delete "1".

In column 5, line 61, delete "dualsurface" and substitute therefor --dual-surface--.

In column 6, line 19, delete "oneplayer" and substitute therefor --one-player--.

In column 6, line 65, delete "witch" and substitute therefor --switch--.

UNITED STATES PATENT AND TRADEMARK OFFICE

CERTIFICATE OF CORRECTION

PATENT NO. : 5,131,654

DATED : July 21, 1992

INVENTOR(S) : Alvin J. Gottlieb et al.

It is certified that error appears in the above-indentified patent and that said Letters Patent is hereby corrected as shown below:

IN THE CLAIMS:

Column 8,

In claim 6, line 7, delete "1".

Column 10,

In claim 16, line 10, delete "1".

Signed and Sealed this

Fourth Day of November, 1997

*Attest:*

*Attesting Officer*

BRUCE LEHMAN

*Commissioner of Patents and Trademarks*